US008784051B2

(12) United States Patent
Marini et al.

(10) Patent No.: US 8,784,051 B2
(45) Date of Patent: Jul. 22, 2014

(54) STRUT FOR A GAS TURBINE ENGINE

(75) Inventors: Remo Marini, Montreal (CA); Edward Vlasic, Beaconsfield (CA); Jonathon Peter Findlay, Edmonton (CA)

(73) Assignee: Pratt & Whitney Canada Corp., Longueuil (CA)

( * ) Notice: Subject to any disclaimer, the term of this patent is extended or adjusted under 35 U.S.C. 154(b) by 951 days.

(21) Appl. No.: 12/164,565

(22) Filed: Jun. 30, 2008

(65) Prior Publication Data

US 2009/0324400 A1 Dec. 31, 2009

(51) Int. Cl.
*F01D 1/02* (2006.01)

(52) U.S. Cl.
USPC ..... 415/189; 415/191; 415/115; 415/211.2; 416/91; 416/97 R

(58) Field of Classification Search
USPC ..... 415/191, 211.2, 115; 416/91, 97 R
See application file for complete search history.

(56) References Cited

U.S. PATENT DOCUMENTS

| | | | | | |
|---|---|---|---|---|---|
| 4,120,150 | A * | 10/1978 | Wakeman | ..... | 60/39.091 |
| 4,222,703 | A * | 9/1980 | Schaum et al. | ..... | 415/58.1 |
| 4,605,315 | A * | 8/1986 | Kokoszka et al. | ..... | 374/144 |
| 4,720,235 | A * | 1/1988 | Lachance et al. | ..... | 415/58.1 |
| 4,768,924 | A | 9/1988 | Carrier et al. | | |
| 4,989,406 | A * | 2/1991 | Vdoviak et al. | ..... | 60/762 |
| 6,139,259 | A * | 10/2000 | Ho et al. | ..... | 415/119 |
| 6,905,303 | B2 * | 6/2005 | Liu et al. | ..... | 415/142 |
| 7,080,971 | B2 * | 7/2006 | Wilson et al. | ..... | 416/92 |
| 7,100,358 | B2 | 9/2006 | Gekht et al. | | |
| 7,320,575 | B2 * | 1/2008 | Wadia et al. | ..... | 416/97 R |

* cited by examiner

*Primary Examiner* — Lex Malsawma
*Assistant Examiner* — Sheng Zhu
(74) *Attorney, Agent, or Firm* — Norton Rose Fulbright Canada LLP

(57) ABSTRACT

The strut is for use in a gas turbine engine has body, typically having an airfoil shape, having a leading edge and a trailing edge. The leading edge has at least one gas inlet in direct fluid communication with at least one outlet located in the trailing edge through which gas may be redirected from the leading edge to the trailing edge through the strut for injection back into a wake region downstream of the strut.

13 Claims, 3 Drawing Sheets

STRUT FOR A GAS TURBINE ENGINE

TECHNICAL FIELD

The field of the invention generally relates to struts for use in gas turbine engines.

BACKGROUND

Struts are circumferentially-disposed, radially-extending elements spanning a gas path of a gas turbine engine and are used for structural purposes and/or to redirect (i.e. de-swirl or pre-swirl) the gas path flow. Struts may be used either in the compressor section or the turbine section, however no matter where the location, inevitably the presence of struts creates losses. One major source of loss created by the struts is the wake due to the presence of the finite trailing edge—unlike turbine or compressor blades or vanes which have very thin trailing edges, gas path struts tend to have larger trailing edge thicknesses, which exacerbates wake losses. Therefor there is room for improvement in strut design.

SUMMARY

In one aspect, the present concept provides a method of reducing wake loss of a strut spanning a gas path of a gas turbine engine, the method comprising the steps of ingesting gas from a gas path flow into the strut through a leading edge of the strut, and discharging the ingested gas flow back into the gas path through the trailing edge of the strut to increase gas pressure in a wake region and thereby decrease strut wake loss.

In another aspect, the present concept provides a gas turbine engine comprising: an annular gas path defined through the engine; and at least one strut extending generally radially relative to the engine from an inner gas path wall to an outer gas path wall, the strut thereby spanning the gas path, the strut having a leading edge with at least on inlet aperture, a trailing edge with at least on outlet aperture and at least one internal passageway extending through the strut between the leading edge and trailing edge apertures, wherein the passageway extends in a substantially unobstructed line between the inlet and outlet apertures.

In a further aspect, the present concept provides a gas turbine engine comprising: an annular gas path defined through the engine; and at least one strut extending generally radially relative to the engine from an inner gas path wall to an outer gas path wall, the strut thereby spanning the gas path, the strut having a leading edge with a plurality of inlet apertures and a trailing edge with plurality of outlet apertures, the strut composed of a peripheral wall enveloping a substantially unobstructed space therein, the substantially unobstructed space providing an open internal passageway extending through the strut fluidly connecting the leading edge and trailing edge apertures.

Further details of these and other aspects will be apparent from the detailed description and figures included below.

DESCRIPTION OF THE FIGURES

Reference is now made to the accompanying figures, in which.

DETAILED DESCRIPTION

Figure 1:
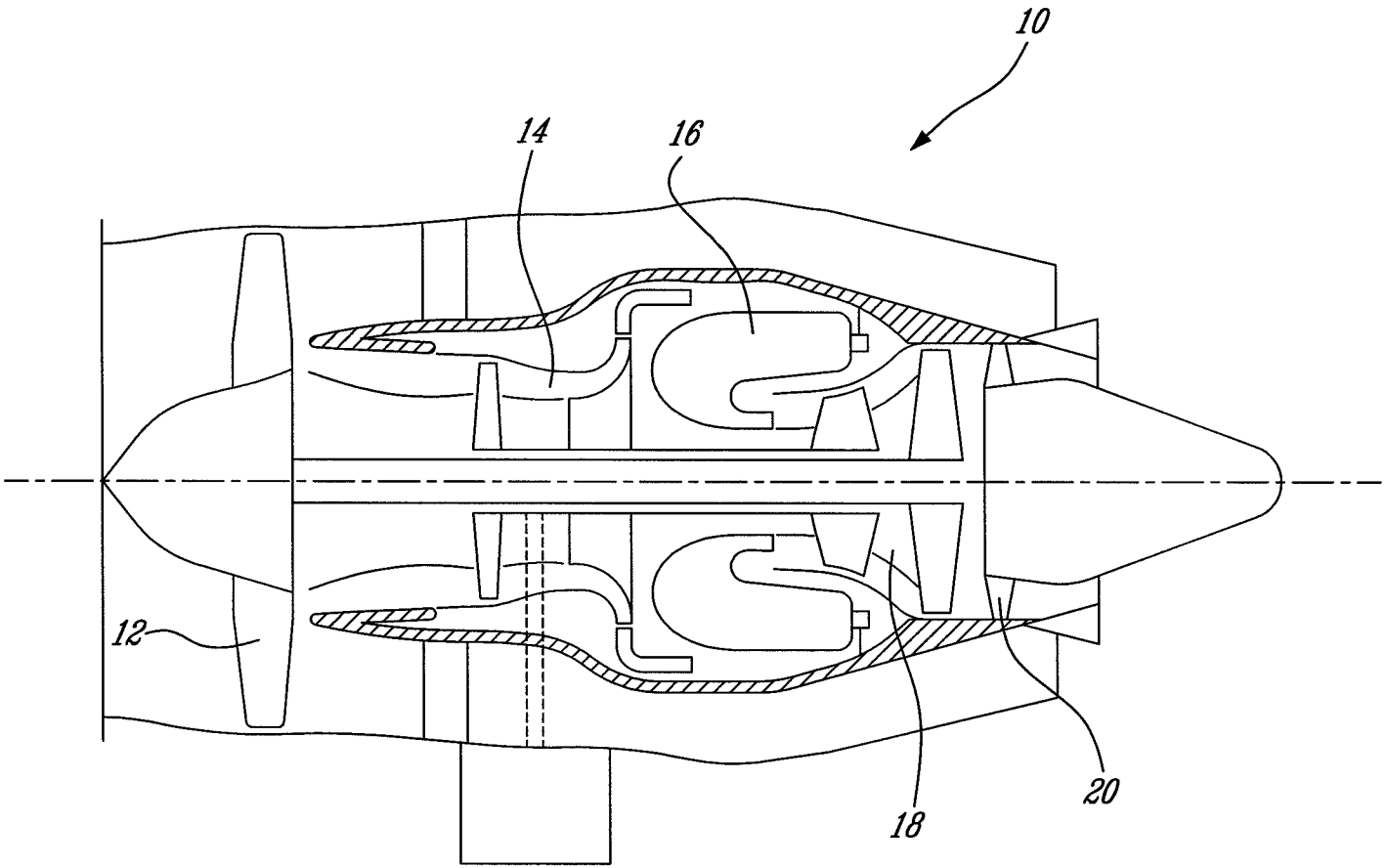
FIG. 1 is gas turbine engine including a strut according to the present teachings.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. Downstream of the turbine section 18 is a turbine exhaust case (unindicated) which includes a plurality of struts 20 in accordance with the teachings hereinbelow.

Figure 3:
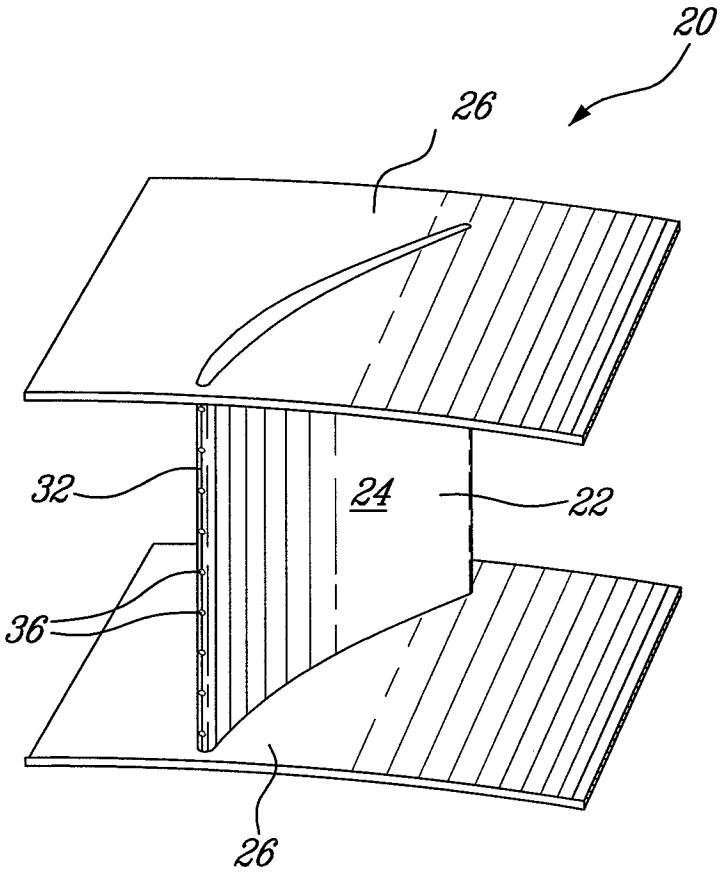
FIG. 3 shows the strut of FIG. 2, as viewed from a trailing edge side.
Figure 2:
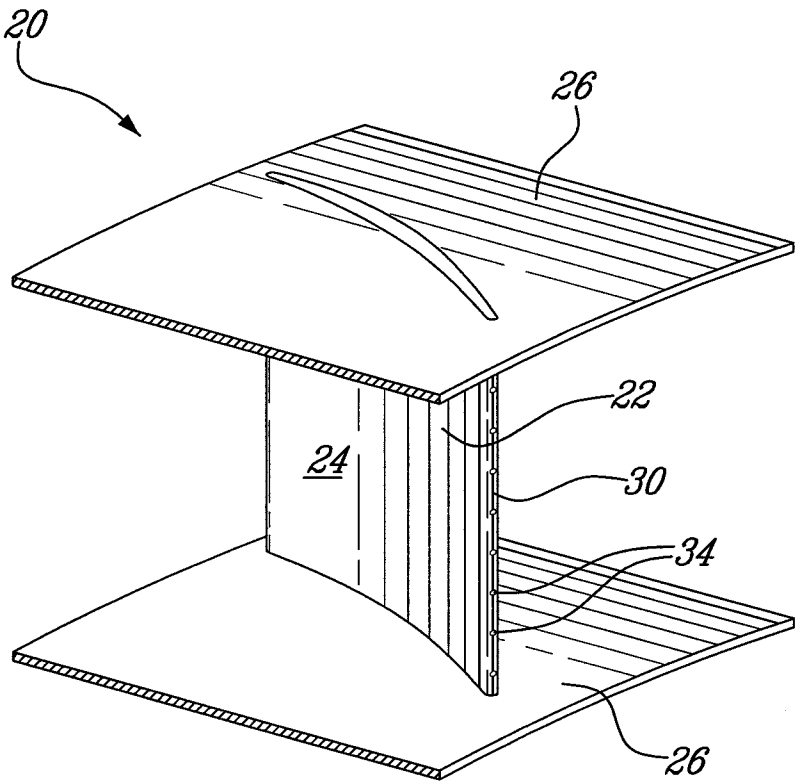
FIG. 2 is isometric view of a portion of the turbine exhaust case of the engine of FIG. 1, showing an example of the strut as viewed from its leading edge side.

FIGS. 2 to 6 show an example of a single such strut 20. As depicted in FIG. 1, this strut 20 can be used as a de-swirl exhaust flow in a turbine exhaust case downstream of the turbine section 18 of the gas turbine engine 10, although application of the present teachings is not limited to turbine deswirlers. FIG. 2 shows that the strut 20 comprises in this example an airfoil 22 having sidewalls 24 extending between two radially spaced-apart platforms 26. The airfoil 22 has a leading edge (LE) 30 and a trailing edge (TE) 32 with reference to the airflow through the gas path of the engine. FIG. 2 shows the strut 20 as it appears from its leading edge 30 and FIG. 3 shows the strut 20 as it appears from its trailing edge 32. A plurality of such struts 20 are conventionally disposed circumferentially side-by-side to form a annular array around the turbine exhaust case assembly. Fabrication of the struts can be done by a combination of casting, machining and welding.

Typically a plurality of larger cross-sectioned structural struts in the array are interspersed by a larger number of deswirler struts. The structural struts (not shown) typical also have an airfoil cross-sectional shape to some extent, although usually with a much greater chord. Some structural struts may have a simple elliptical shape, or hybrid of an ellipse and an airfoil. Regardless of shape or function, the present teachings may be suitably applied.

The strut 20 has a plurality of inlet holes 34 radially spaced apart in the leading edge 30, each holes 34 preferably located at the nominal location of LE stagnation point of the airfoil. A plurality of outlet holes 36 are also provided in the trailing edge 32, also preferably at the nominal location of the TE stagnation point. The numbers, positioning, shaping, spacing, sizing, etc of the holes are selected by the designer to provide the desired performance characteristics, as will be appreciated by he reader in light of the teachings herein. For example, holes 34 may comprise slots, rather than circular holes. A single substantially continuous slot may be desired instead of a plurality of discrete openings. And so on, the designer has latitude to design a system suitable to the application at hand.

Figure 6:
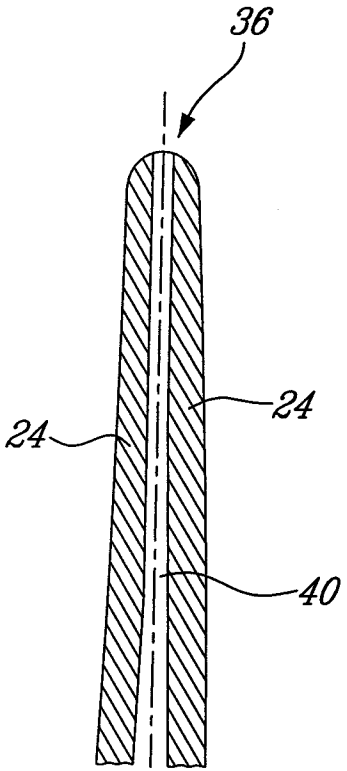
FIG. 6 is a view similar to FIG. 5, showing the trailing edge of the strut shown in FIG. 2.
Figure 5:
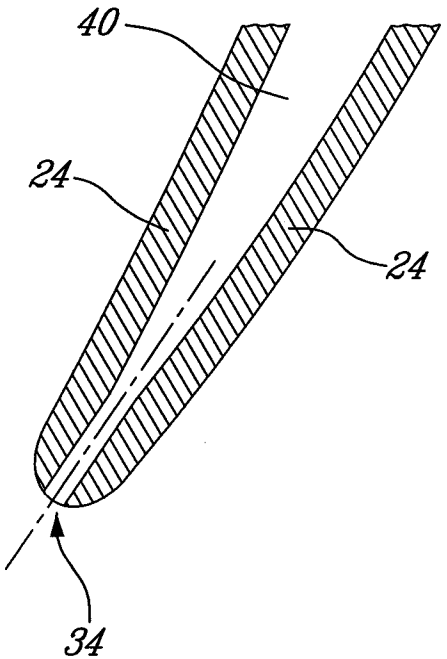
FIG. 5 is an enlarged cross-sectional view of the leading edge of the strut shown in FIG. 2.
Figure 4:
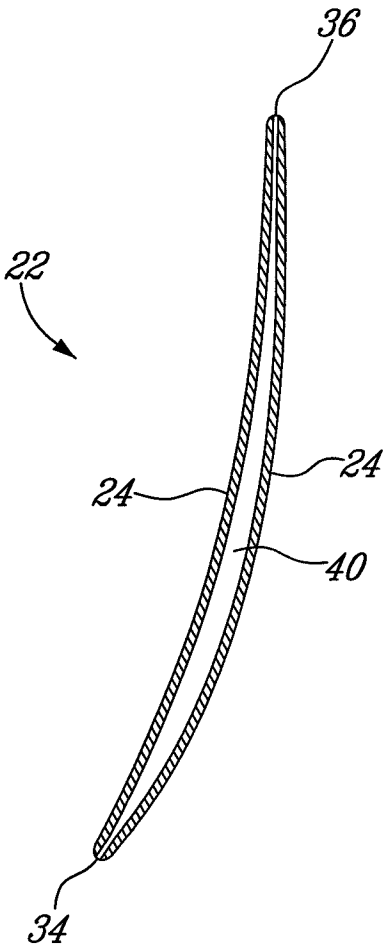
FIG. 4 is a cross-sectional view of the strut shown in FIG. 2.

Referring to FIG. 4, the holes 34, 36 are in direct fluid communication with each other through one or more chordwise-extending passageways 40 within the airfoil 22. The inlet holes 34, the passageway or passageways 40 and the outlet holes 36 are designed so as to minimize pressure losses as much as possible for air passing therethrough, that is the passageways are preferably substantially unobstructed and designed to minimize flow losses as much as necessary to facilitate the desired flow of gas through the strut, as will be described further below. FIGS. 5 and 6 are enlarged views of a representative hole 34 at the leading edge 30 and a representative hole 36 at the trailing edge 32, respectively.

In use, as the gas turbine engine is operated, a flow of gas passes around the strut (in this example, the flow is turbine exhaust exiting the turbine portion of the engine). When a gas flow approaches the strut, the flow separates to pass around either side of the strut, and then the flow reattaches downstream of the strut. This action tends to create a wake effect at the trailing edge. However, a portion of the gas path flow at the leading edge 30 is ingested into the strut through holes 34, and passed to the trailing edge holes 36 though passage(s) 40, which tends to energize the wake caused by the strut, and thereby tends to reduce the wake loss. Gas from the mainstream is thus allowed to travel through holes or slots located at the leading edge of an array of struts and out through holes or slots located at the trailing edge. The resultant flow, driven by the pressure difference between strut leading and trailing edges, is injected at the wake location and is preferably injected in sufficient quantity to increase the base pressure in the wake zone and thereby reduce the loses produced by the finite trailing edge thickness.

Although it is known to provide cooled turbine blades and vanes with holes aligned along a leading or trailing edge of the airfoil, it is important to note that such holes in cooled blades/vanes are used for the purpose of exhausting cooling air from within the airfoil cavity to the gas path. It is also important to understand, as the skilled reader will, that ingestion of gas path air into such cooled, turbine blades/vanes is to be avoided, as it has a detrimental impact on the durability due to the extremely high, temperatures present within the turbine section. As such, turbine blade/vane, leading edge holes are, for example, designed to avoid air ingestion, i.e. to avoid allowing air to enter into the interior of the blade/vane. In contrast, one will observe that struts of the type described herein are uncooled (e.g. no cooling air is independently provided to the strut interior), and that the placement of the present struts outside the turbine section of the engine (e.g. downstream of the turbine section in a turbine exhaust case, or in a compressor section upstream of the combustor, or in a bypass section of the engine) presents a different set of design concerns than those facing the turbine blade/vane designer. Therefore, in contrast to the teachings generically available in the turbine blade/vane art, gas ingestion is encouraged in the present approach to re-use the ingested flow to energize the TE wake.

The above description is meant to be exemplary only, and one skilled in the art will recognize that changes may be made to the embodiments described without departing from the scope of the invention disclosed. For example, the shape of the strut and its purpose can be any suitable shape/purpose and may be different than that shown in the figures. The shape and the configuration of the holes therein can also be any suitable; for example, one or more slots may be provided instead of holes at the leading edge and/of trailing edge. The number of holes/slots in the leading and trailing edges need not be the same. If more than one passageway is provided inside the airfoil, the number of holes/slots need not be equal or symmetrical from one passageway to another. Passageways may communicate with each other inside the airfoil or be separate. The struts and their features may be manufactured in any suitable manner. Not all struts in a strut array need be provided with the present apparatus. Still other modifications which fall within the scope of the present invention will be apparent to those skilled in the art, in light of a review of this disclosure, and such modifications are intended to fall within the appended claims.

What is claimed is:

1. A gas turbine engine comprising:

an annular gas path defined through the engine;

at least one strut extending generally radially relative to the engine from an inner gas path wall to an outer gas path wall and composed by a peripheral wall enveloping an empty inner space, the strut thereby spanning the gas path, the strut having a leading edge located upstream relative to the annular gas path with a plurality of inlet apertures being radially spaced apart from one another, a trailing edge located downstream relative to the annular gas path with a plurality of outlet apertures being radially spaced apart from one another, the trailing edge being located at a wake effect zone; and at least one strut gas path defined by at least an internal passageway in the empty inner space of the strut, the passageway extending through the empty inner space of the strut between the leading edge and trailing edge apertures, wherein the strut gas path extends in a substantially unobstructed line between the inlet and outlet apertures and through the empty inner space to converge with the annular gas path in the wake effect zone.

2. The gas turbine engine of claim 1 wherein the passageway provides a substantially straight line path between the inlet and outlet apertures.

3. The gas turbine engine of claim 1 wherein the strut has a cross-sectional shape which is substantially airfoil-shaped.

4. The gas turbine engine of claim 1 wherein the strut spans the gas path downstream of a final outlet of a turbine section.

5. The gas turbine engine of claim 1 wherein the strut spans the gas path upstream of a combustor section.

6. The gas turbine engine of claim 1 wherein the gas path is defined through a bypass duct of a turbofan engine.

7. The gas turbine engine of claim 1 wherein the inlet apertures are located at a leading edge stagnation point of the strut.

8. The gas turbine engine of claim 1 wherein the strut is in a turbine exhaust case.

9. The gas turbine engine of claim 8 wherein the strut is a deswirler configured to deswirl the gas path flow prior to the exiting the engine.

10. A gas turbine engine comprising:

an annular gas path defined through the engine;

at least one strut extending generally radially relative to the engine from an inner gas path wall to an outer gas path wall, the strut thereby spanning the gas path, the strut having a leading edge located upstream relative to the annular gas path with a plurality of radially spaced-apart inlet apertures and a trailing edge located downstream relative to the annular gas path at a wake effect zone with a plurality of radially spaced-apart outlet apertures, the strut composed of a peripheral wall enveloping a substantially unobstructed and empty space therein; and at least one strut gas path defined by an open internal passageway in the substantially unobstructed space, the strut gas path extending through the strut fluidly connecting the leading edge and trailing edge apertures to converge with the annular gas path in the wake effect zone.

11. The gas turbine engine of claim 10 wherein the strut is provided in a turbine exhaust case downstream of a final exit of a turbine section of the engine.

12. The gas turbine engine of claim 10 wherein the inlet apertures are located at a leading edge stagnation point of the strut.

13. The gas turbine engine of claim 10 wherein the inlet apertures are sized and configured to ingest air from the gas path.

* * * * *